United States Patent [19]

Clawges

[11] Patent Number: 4,522,405

[45] Date of Patent: Jun. 11, 1985

[54] GOLF PUTTER

[76] Inventor: Charles A. Clawges, P.O. Box 356, Georgetown, S.C. 29440

[21] Appl. No.: 615,598

[22] Filed: May 31, 1984

[51] Int. Cl.[3] ..... A63B 53/04

[52] U.S. Cl. ..... 273/167 A; D21/217

[58] Field of Search ..... 273/167 A, 168, 175, 273/167 B, 167 D, 167 J, 169, 78; D21/217, 218, 219, 174, 173

[56] References Cited

U.S. PATENT DOCUMENTS

| | | | |
|---|---|---|---|
| D. 240,245 | 6/1976 | Aragona | 273/168 X |
| 656,099 | 8/1900 | Dunn | 273/175 |
| 1,743,957 | 1/1930 | Carr | 273/167 A X |
| 3,333,854 | 8/1967 | White | 273/168 X |

FOREIGN PATENT DOCUMENTS

| | | | |
|---|---|---|---|
| 377463 | 7/1932 | United Kingdom | 273/167 A |

*Primary Examiner*—George J. Marlo

*Attorney, Agent, or Firm*—Jacobi, Siegel, Presta, Marzullo & Aronson

[57] ABSTRACT

A golf putter that significantly reduces the chances of stubbing a putt, i.e., engaging the surface of the green before the golf ball is engaged so as to interrupt the normal forward stroke of the putter. The golf putter comprises a substantially smooth bottom surface disposed in a substantially flat plane that is upwardly inclined from the rear face to the front face of the putter head to provide an elevated front bottom edge portion on the putter head.

1 Claim, 2 Drawing Figures

GOLF PUTTER

BACKGROUND OF THE INVENTION

The present invention relates to a golf putter and, more particularly, to a golf putter that is so constructed as to reduce the chance of stubbing a putt, i.e., engaging the surface of the green with the lower front edge of the putter head before the ball is engaged.

Many golfers, including professionals, occasionally misplay a putt because they unintentionally engage the surface of the green with the lower front edge of the putter head before engaging the golf ball which disrupts the smooth forward motion of the putter head and usually results in a missed putt. In golf jargon, this is known as "stubbing" a putt.

Although the stubbing of putts has been a problem for inexperienced and experienced golfers since the inception of the game of golf, there has not been available a golf putter that effectively reduces the chances of stubbing a putt without significant changes in construction of the putter head that adversely affect its use. Accordingly, a need has arisen for a new and improved golf putter that is simple in construction and effectively reduces the chances of stubbing a putt. The golf putter of the present invention fulfills this need.

SUMMARY OF THE INVENTION

In the golf putter of the present invention, the bottom surface of the putter head is inclined upwardly in a generally flat plane from the rear face to the front face of the putter head. Preferably the inclination is approximately ⅛ of an inch in height at the front putter face so as not to materially reduce the area of the putter face and to allow it to engage the center of the golf ball in a normal manner.

By providing an inclined, smooth and substantially flat bottom surface on the putter, the chances of stubbing a putt are significantly reduced. Since the front lower edge of the putter is elevated, it will not engage the surface of the green before the golf ball is engaged. Also, because of the smooth, inclined bottom surface, it will tend to slide smoothly over the surface of the green like a sled in the event the surface of the green is engaged before the golf ball, thereby preventing significant deflection of the putter head or interruption of the forward putting stroke.

DESCRIPTION OF THE PREFERRED EMBODIMENT

Figure 1:
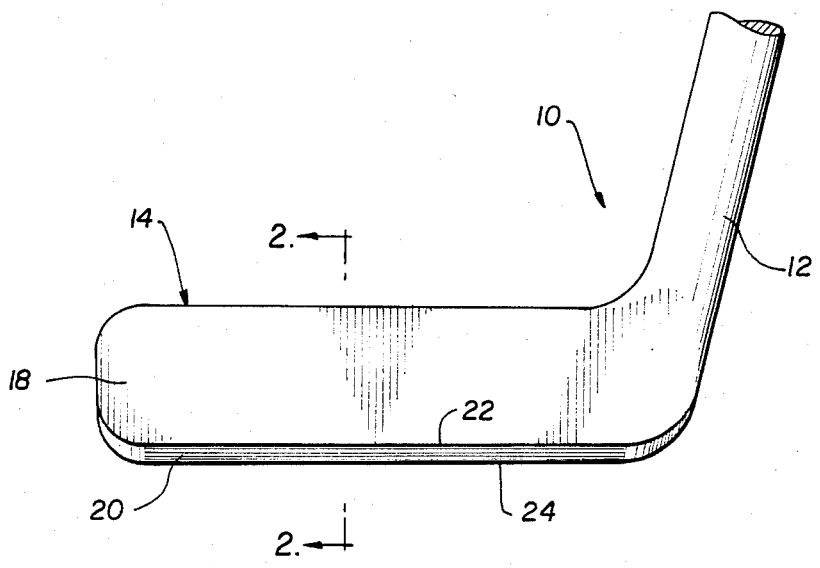
FIG. 1 is a front elevational view, with parts broken away, of a golf putter constructed in accordance with the principles of the present invention.
Figure 2:
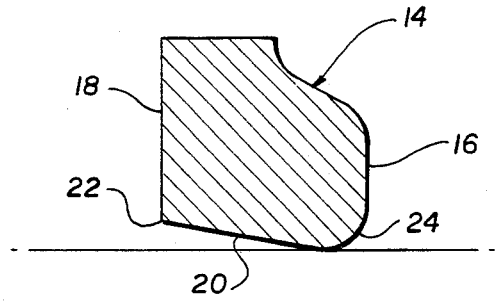
FIG. 2 is a sectional view taken substantially along line 2—2 in FIG. 1.

As shown in FIGS. 1 and 2, the golf putter 10 of the present invention generally comprises a shaft 12 and a head 14 having a rear face 16, a front face 18 and a bottom surface 20. The shaft 12 and the putter head 14 may be of any suitable shape and formed of any suitable materials such as metal.

The bottom surface 20 is substantially smooth and is disposed in a substantially flat plane that is inclined upwardly from the rear face 16 to the front face 18 a distance that is sufficient to raise the bottom front edge portion 22 of the putter to an extent that the chances of stubbing a putt are significantly reduced. In practice, it has been found that the amount of inclination of the bottom surface 20 should be such that the bottom front edge portion 22 is raised approximately ⅛ of an inch from the bottom rear edge portion 24 of the putter. This distance does not significantly change the size of the front putter face 18 and allows it to engage the center of the golf ball in a normal manner so as not to adversely affect the putting stroke.

Because of the substantially smooth, flat and upwardly inclined bottom face 20, it will tend to slide over the surface of the green like a sled in the event it engages the surface of the green before the front face 18 engages the golf ball, with the result that the normal putting stroke will not be adversely affected and the chances of stubbing a putt will be materially reduced.

As shown in FIG. 2, the bottom rear edge portion 24 is curved and merges smoothly with the bottom surface 20 so that it will slide easily over the surface of the green in the event it engages it during the forward putting stroke.

I claim:

1. A golf putter, comprising:

a head having a front face for striking golf balls, a rear face and a bottom surface, said bottom surface being substantially smooth and being disposed in a substantially flat plane that is inclined downwardly and substantially continuously from said front face toward said rear face, said flat plane extending from the lower edge of said front face to a position proximate said rear face, said bottom surface being joined generally tangentially to a curved surface connecting said bottom surface and said rear face, whereby the lower edge of said front striking face is slightly elevated relative to said curved connecting surface and said bottom surface will slide over the surface of a green like a sled in the event it engages the surface of the green before said front face engages the golf ball.

* * * * *